US006513291B2

(12) United States Patent
Gilsdorf

(10) Patent No.: US 6,513,291 B2
(45) Date of Patent: Feb. 4, 2003

(54) CONCRETE SLAB CONSTRUCTION FOR BUILDING COLUMNS

(76) Inventor: David R. Gilsdorf, 26101 E. 155, Pleasant Hill, MO (US) 64080

( * ) Notice: Subject to any disclaimer, the term of this patent is extended or adjusted under 35 U.S.C. 154(b) by 0 days.

(21) Appl. No.: 09/840,442

(22) Filed: Apr. 23, 2001

(65) Prior Publication Data

US 2002/0152695 A1 Oct. 24, 2002

(51) Int. Cl.[7] ..... E02D 27/42

(52) U.S. Cl. ..... 52/297; 52/98; 52/247; 52/298; 52/396.02; 52/576; 52/364

(58) Field of Search ..... 52/98, 247, 248, 52/298, 297, 296, 396.02, 396.04, 396.05, 742.14, 742.15, 745.17, 576, 577, 364; 249/207

(56) References Cited

U.S. PATENT DOCUMENTS

| | | | | | |
|---|---|---|---|---|---|
| 1,443,459 | A | | 1/1923 | Carty | |
| 1,482,565 | A | * | 2/1924 | Johnson et al. | 52/577 |
| 2,809,415 | A | | 10/1957 | Couelle | |
| 3,798,867 | A | * | 3/1974 | Starling | 52/721.4 |
| 4,563,847 | A | * | 1/1986 | Hasty | 52/98 X |
| 4,598,517 | A | * | 7/1986 | Alvarsson | 52/364 |
| 4,673,157 | A | | 6/1987 | Wells | |
| 4,830,543 | A | | 5/1989 | Joubert | |
| 5,072,911 | A | * | 12/1991 | Logsdon | 249/61 |
| 5,154,837 | A | | 10/1992 | Jones | |
| 5,224,313 | A | * | 7/1993 | Guillebeau, III | 52/297 |
| 5,271,203 | A | * | 12/1993 | Nagle | 52/721.4 |
| 5,399,050 | A | | 3/1995 | Jacobus | |
| 5,678,475 | A | | 10/1997 | Villar Otero | |
| 5,890,333 | A | | 4/1999 | Boroviak | |
| 6,021,994 | A | | 2/2000 | Shartzer, Jr. | |
| 6,289,638 | B1 | * | 9/2001 | Vasseur | 52/98 |
| 6,336,620 | B1 | * | 1/2002 | Belli | 52/296 X |

* cited by examiner

*Primary Examiner*—Robert Canfield
*Assistant Examiner*—Brian E. Glessner
(74) *Attorney, Agent, or Firm*—Shook, Hardy & Bacon L.L.P.

(57) ABSTRACT

A concrete slab construction in which a building ring is used to isolate the slab from a column which supports upper parts of a building. The ring is placed on a concrete pier beneath the column. Concrete may be poured to form a slab outside of the ring and also inside the cavity formed within the ring. The column maybe placed directly on the pier before the ring is filled with concrete or on the concrete which is poured inside the ring. The ring may be tapered from bottom to top to enhance isolation of the column and pier from the slab. The ring may be adjustable in diameter and height and may have a fastening foot for securing the ring in place on the pier.

13 Claims, 1 Drawing Sheet

CONCRETE SLAB CONSTRUCTION FOR BUILDING COLUMNS

FIELD OF THE INVENTION

This invention relates in general to concrete work and more particularly to an improved concrete slab construction and a method of constructing a slab in a building having an upright column standing on a pier footing.

BACKGROUND OF THE INVENTION

In many types of construction, building posts or columns serve a significant load bearing function. For example, posts are often installed in basements and other areas to support beams which in turn provide support for overlying parts of a building. In order to provide a stable footing for such posts and to prevent moisture, frost heave and other forces from displacing them, the posts are typically installed on concrete pads or piers which are set into the ground, often to a considerable depth in order to bear the load and resist frost heave.

When a basement floor or other concrete slab is poured, it is necessary to isolate the post from the slab. Otherwise, if the slab is pushed upwardly by moisture induced expansion of the soil or is otherwise displaced, the post can be displaced with it and lead to major structural problems in the building. To avoid this, isolation of the post is required so that the slab can move independently of the post and the pier which underlies it.

It is common practice for workers to place a tube or a bucket on the pier so that when the slab is poured, the bucket or tube creates a round cavity in which the base of the post can be placed when the post is installed. A disadvantage to this practice is that it involves several steps, including placement of the bucket, removal of the bucket after the slab has been poured, and subsequent filling of the hole around the post with additional concrete. When pouring the additional concrete, it is difficult to match the finish of the floor and maintain a flat grade. The need for so any different steps in the building procedure, all at different times, also delays the process and adds to its cost. Even then, there is often incomplete isolation of the post and pier from the slab. A bucket or tube also has the disadvantage that it cannot be placed around a post that is already in place.

Another practice that has been used involves constructing a wooden box around the post and using the box as a form to separate the slab from the column and pier. The advantage of such a box is that it can be built around a post that is already in place. The disadvantages include the considerable time that is required to construct the box and a tendency for the concrete to crack in the corner areas of the box. The problems encountered in using an isolation box type form are similar to those encountered when using a bucket.

SUMMARY OF THE INVENTION

The present invention is directed to an improved concrete slab which makes use of a unique ring structure to isolate a building post from the slab. The invention is also directed to a method of using the ring for efficient and effective construction of the slab.

In accordance with the invention, a specially constructed ring can be placed on a concrete pier to extend around the location of a post or column which is to be supported on the pier. Concrete is poured outside of the ring to form a basement floor or other slab, and also inside of the ring, either around a column that is set directly on top of the pier or in a manner to completely fill the ring so that a column can subsequently be set on the concrete which fills the ring. The result of this construction technique is that the ring is embedded in the concrete slab and provides effective isolation of the column from the part of the slab located outside of the ring. Consequently, displacement of the slab does not displace the column to possibly create structural problems in the upper part of the building. Instead, the concrete located inside of the ring remains in place even if the slab shifts elsewhere. At the same time, all of the concrete can be poured at a single time in a single step to expedite the construction process and make it more efficient than in a case where multiple steps are required.

The construction ring preferably exhibits various features which enhance its utility and versatility. It may be tapered from bottom to top to prevent upward displacement of the slab outside of the ring from creating displacement of the concrete inside of the ring. This assures effective isolation of the column from the slab and reduces shear forces.

Another feature of the ring is that it may have overlapping ends which are detachably connected so that the diameter of the ring can be adjusted in accordance with the size of the column and other particularities that may be involved. This feature accommodates columns of different diameters and also allows the same ring to be used in a variety of different applications and with a variety of different types and sizes of columns.

The height or depth of the ring may be made adjustable. The ring can have detachable tear strips that allow its height to be reduced when the tear strips are removed. For example, a ring may be used for a 4½" slab, and a ring having the same construction can also be used for a 3½" slab simply by removing one or more of the tear strips.

A fastening foot may be provided on the ring to allow it to be readily fastened to the underlying pier. The foot may take the form of a tab which can be folded from the lower edge of the ring so that it lies flatly on top of the pier. A concrete nail or other fastener can then be applied to secure the ring in the desired position on the pier. The ring can be accurately held in a concentric relationship to the post while the concrete is being poured and is not susceptible to being dislodged by the force of the concrete or other forces. Consequently, the post can be accurately centered in the ring in the final slab structure, and this results in a sound overall construction.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 2:
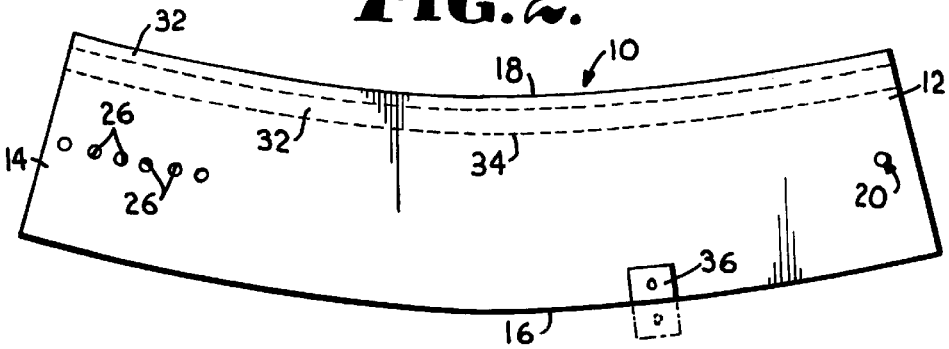
FIG. 2 is an elevational view of the ring shown in FIG. 1 with the normally overlapping ends detached and the ring disposed in a flat condition.

Referring now to the drawings in more detail, the present invention is directed to a concrete slab construction and to a method of constructing a slab which makes use of a special building ring generally identified by numeral 10. As best shown in FIG. 2, the ring 10 may initially take the form of a flat piece of thin plastic or another material that can be rolled into the form of a ring. The flat piece of plastic or other material from which the ring 10 is formed has an arcuate shape having opposite end portions 12 and 14 that are overlapped when the material is rolled into the form of a ring. The curved or arcuate initial shape is so that the ring 10 assumes a frusto-conical shape when formed into a ring. The material has a lower edge 16 and an upper edge 18 which is shorter than the lower edge 16. Consequently, the ring 10 tapers from bottom to top when the opposite ends 12 and 14 are overlapped and secured in a manner that will be described.

Figure 4:
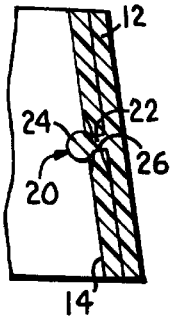
FIG. 4 is a fragmentary sectional view taken generally along line 4—4 of FIG. 3 in the direction of the arrows
Figure 3:
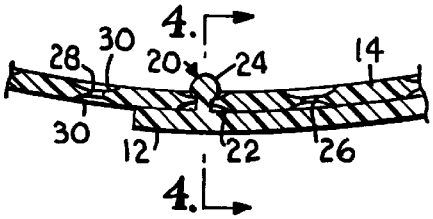
FIG. 3 is a fragmentary sectional view on an enlarged scale taken generally along line 3—3 of FIG. 1 in the direction of the arrows.

End portion 12 of the ring is provided with a projecting pin 20. As best shown in FIGS. 3 and 4, the pin 20 has a cylindrical shank 22 and an enlarged spherical tip 24 carried on the end of the shank 22. The opposite end portion 14 of the ring is provided with a series of spaced apart openings 26. As shown in FIG. 3, each opening 26 may have a central passage 28 which intersects at its opposite ends with dish-shaped depressions 30 formed in the opposite surfaces of the ring 10. The shank 22 of pin 20 may be substantially equal in diameter to the passage 28, while the spherical tip 24 is larger than the passage but can be forced through it in order to secure the ends 12 and 14 in overlapping relation. The openings 26 are spaced apart along a line that is parallel to each edge 16 and 18. Consequently, the diameter of ring 10 can be varied depending upon which of the openings 26 receives the pin 20.

The extent of the overlap of the end portions 12 and 14 can be adjusted by inserting pin 20 in a different one of the openings 26. By way of example, the diameter of the ring at the lower edge 16 may be adjustable between limits such as between 12 inches at a minimum and 20 inches at a maximum. Other diameters may be provided as well, and other manners of adjusting the length of the ring 10 may be provided as an alternative to the pin and opening arrangement shown in the drawings.

The height or depth of the ring 10 between the lower edge 16 and the upper edge 18 can be selected depending upon the depth of the concrete slab with which the ring 10 is to be used.

For example, the ring 10 may be constructed with a distance of 4½ inches between edges 16 and 18 so that a slab having a depth of 4½ inches can be constructed. Other heights of the ring can be used as well.

Preferably, the ring 10 is provided with a plurality of detachable tear strips 32 (see FIG. 2) which are separated from one another by perforated tear lines 34. In order to vary the height of the ring 10, the tear strips 32 can be torn away from the body of the ring. By way of example, each tear strip may have a width of ½ inch. Accordingly, assuming an initial ring height of 4½ inches, the upper tear strip 32 may be torn away along the weakened tear line 34 to provide the ring 10 with a height of 4 inches. If a height of 3½ inches is desired, the second tear strip 32 may be torn away long its tear line 34 to reduce the height of the ring 10 to the desired 3½ inches. It should be evident that the initial height of the ring and the tear strips can have different dimensions and that virtually any desired number of tear strips can be provided. Also, adjustment of the height of the ring 10 can be carried out in ways other than by providing the tear strips 32.

The taper of the ring 10 from bottom to top between the edges 16 and 18 can vary. By way of example, a ring having a height from bottom to top of 4 inches can have a wall that tapers ¾ inch inwardly from bottom to top. The diameter at the bottom edge 16 may be 12 inches, and the diameter at the top may be 10½ inches. The exact degree of the taper is not critical in most applications but should be sufficient to provide effective isolation and to allow stacking of the rings if that is desired.

The ring 10 may be provided at its lower edge 16 with a nailing foot 36. The foot 36 may be a flat tab or flap that can be folded outwardly from the lower edge 16 so that it lies on top of the flat upper surface of a concrete pier 38 of the type commonly used in building construction to provide a footing for support columns or posts. A fastener 40 (see FIGS. 1 and 5) such as a concrete nail may be driven through the nailing foot 36 and into the pier 38 in order to secure the ring 10 at the desired position on the pier 38.

Figure 1:
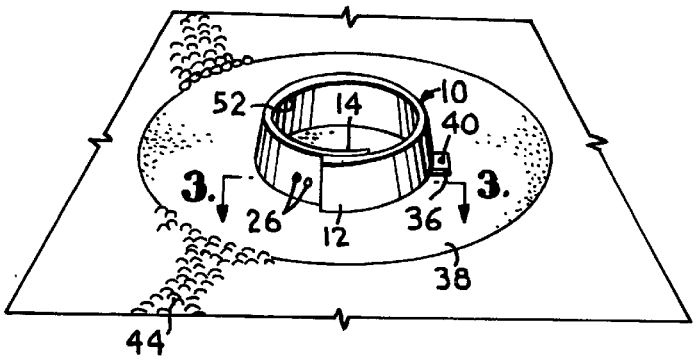
FIG. 1 is a perspective view showing a construction ring in accordance with a preferred embodiment of the present invention applied on top of a concrete pier preparatory to the pouring of a concrete slab and the installation of a building column.
Figure 5:
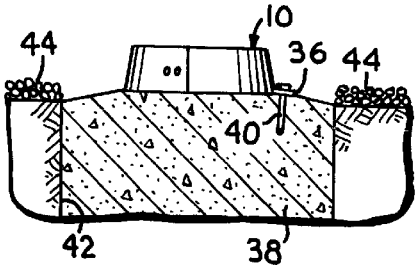
FIG. 5 is a sectional elevational view showing the ring applied to the concrete pier prior to pouring of a concrete slab and installation of a column.
Figure 6:
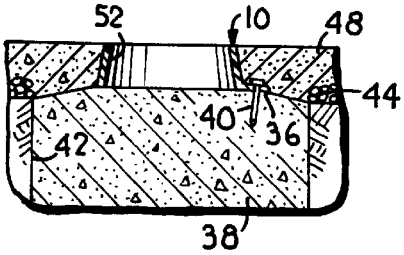
FIG. 6 is an elevational sectional view similar to FIG. 5 but showing a concrete slab poured in the area outside of the ring.

In accordance with the present invention, the building ring 10 is used in connection with the construction of a concrete slab having an upright column or post which supports overlying portions of a building. As shown in FIGS. 1 and 5, the concrete footing pad or pier 38 is poured in a hole 42 which is dug in the ground to the depth desired for the pier. A depth of gravel 44 underlies the concrete slab and is arranged so that it is approximately level with the upper surface of the pier 38.

The ring 10 is then adjusted to the desired diameter, and one or more of the tear strips 32 may be removed in order to adjust the height of the ring 10 to accommodate the depth of the slab which is to be poured. The ring 10 is then placed at the center of the upper surface of the pier 38 so that it is concentric with the post which is to be applied to the pier 38. The fastening foot 36 may be folded out onto the surface of the pier 38, and the nail 40 may be driven through the fastening foot and into the pier 38 in order to secure the ring 10 in place.

Figure 7:
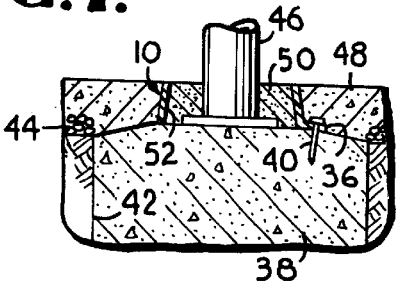
FIG. 7 is an elevational sectional view similar to FIGS. 5 and 6, but showing the concrete slab fully poured and a building post installed on top of the pier inside of the ring, with the base of the post embedded in concrete poured inside of the ring.

An upright post 46 (FIG. 7) may then be placed with its base resting on top of the pier 38 at a centered position within the ring 10, as shown in FIG. 7. Concrete may be poured to form a portion 48 of the slab outside of the ring 10 and another portion 50 inside of the ring 10. The concrete 50 within the ring fills a cavity 52 which is formed around the base of post 46 inside of the ring. In this construction, the base of the post is embedded in the slab portion 50 located inside of the ring. Once the concrete has cured, the slab construction is completed.

The ring 10 remains in place embedded in the concrete slab to separate the majority of the slab 48 from the portion

50 located inside of the ring immediately around the base of the post 46. The ring 10 thus serves to isolate portion 48 of the slab from the pier 38 and also from the post 46 and the portion 50 of the slab located inside of the ring. Consequently, if frost heave or other forces push the slab portion 48 upwardly, portion 48 can be displaced without disturbing portion 50 or the pier 38 or post 46. In this respect, it is noted that the portion 48 can easily move upwardly along the outer surface of the ring without disturbing the ring or anything inside of it due to the tapered shape of the ring 10 from bottom to top.

As an alternative construction, the portions 48 and 50 of the slab can be poured before the post 46 is set in place, and the base of the post can thereafter be set on top of and centered on portion 50 of the slab. In this case also, the ring 10 is embedded in the slab and provides isolation 20 of portion 50 of the slab from portion 48 so that disruption of portion 48 does not result in displacement of portion 50 or the post 46. Another advantage of the ring 10 is that its detachable ends 12 and 14 allow it to be placed around a post that is already in place on the. pier 38, thus enhancing the versatility of the ring and expanding the types of applications in which it can be used.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. In combination with a building pier and an upright column supported on the pier, the improvement comprising:

a ring seated on the pier and surrounding the column to present a cavity around the column within the ring, said ring having a substantially frusto-conical shape and being tapered from bottom to top said ring being formed of strip of material having edges that overlap; and said ring being embedded in a concrete slab which fills said cavity and an area outside of the ring to isolate the concrete in said cavity from the concrete in the slab outside of said ring.

2. The improvement of claim 1, wherein said ring is adjustable in height from bottom to top.

3. The improvement of claim 2, wherein said ring includes at least one detachable strip that can be detached to adjust the height of said ring.

4. The improvement of claim 3, wherein said ring includes overlapping opposite end portions that are adjustable as to the extent of their overlap to adjust the distance around said ring.

5. The improvement of claim 1, wherein said ring includes overlapping opposite end portions that are adjustable as to the extent of their overlap to adjust the distance around said ring.

6. The improvement of claim 4, including a nailing foot on said ring extending therefrom at a location to overlie the pier and adapted to be nailed to the pier.

7. The improvement of claim 3, including a nailing foot on said ring extending therefrom at a location to overlie the pier and adapted to be nailed to the pier.

8. The improvement of claim 1, including a nailing foot on said ring extending therefrom at a location to overlie the pier and adapted to be nailed to the pier.

9. A building floor construction, comprising:

a building pier;

an upright column supported on said pier;

a ring seated on said pier and extending substantially around said column to present a cavity around the column within the ring, said ring having a substantially frusto-conical shape and being tapered from bottom to top; and a concrete slab embedding said ring therein and having a first portion substantially filling said cavity and a second portion outside of the ring, said ring substantially isolating said first portion from forces applied to said second portion and said ring having overlapping opposite end portions that are adjustable as to the extent of their overlap to adjust the distance around the ring.

10. A floor construction as set forth in claim 9, wherein said ring has a projecting fastening foot overlying the pier and fasted thereto.

11. A floor construction as set forth in claim 9, wherein said ring has an adjustable height.

12. A building floor construction, comprising:

a building pier;

an upright column supported on said pier;

a ring seated on said pier and extending sabstantially around said column to present a cavity around the column within the ring, said ring having a substantially frusto-conical shape and being tapered from bottom to top and said ring including at least one detachable tear strip that can be detached to adjust the height of said ring; and a concrete slab embedding said ring therein and having a first portion substantially filling said cavity and a second portion outside of the ring, said ring substantially isolating said first portion from forces applied to said second portion.

13. A floor construction as set forth in claim 12, wherein said ring includes overlapping opposite end portions that are adjustable as to the extent of their overlap to adjust the distance around said ring.

* * * * *